United States Patent [19]

Serita

[11] Patent Number: 5,038,170

[45] Date of Patent: Aug. 6, 1991

[54] COOLING SYSTEM FOR AN IMAGE FORMING APPARATUS

[75] Inventor: Nobuhito Serita, Yokohama, Japan

[73] Assignee: Kabushiki Kaisha Toshiba, Kawasaki, Japan

[21] Appl. No.: 497,309

[22] Filed: Mar. 22, 1990

[30] Foreign Application Priority Data

Mar. 30, 1989 [JP] Japan ..... 1-79608
Mar. 30, 1989 [JP] Japan ..... 1-79609
Mar. 30, 1989 [JP] Japan ..... 1-79610

[51] Int. Cl.[5] ..... G03G 15/00; G03G 21/00

[52] U.S. Cl. ..... 355/200; 355/30; 355/215

[58] Field of Search ..... 355/200, 215, 210, 30

[56] References Cited

U.S. PATENT DOCUMENTS

| | | | |
|---|---|---|---|
| 4,093,368 | 6/1978 | Nishikawa | 355/210 |
| 4,178,092 | 12/1979 | Yamamoto et al. | 355/200 |
| 4,202,618 | 5/1980 | Waschk et al. | 355/215 X |
| 4,515,465 | 5/1985 | Miyoshi et al. | 355/206 |
| 4,540,268 | 9/1985 | Toyono et al. | 355/210 |
| 4,693,588 | 9/1987 | Yarbrough et al. | 355/215 X |
| 4,695,151 | 9/1987 | Watanabe | 355/30 X |
| 4,720,727 | 1/1988 | Yoshida | 355/215 |

FOREIGN PATENT DOCUMENTS

| | | | |
|---|---|---|---|
| 0316010 | 5/1989 | European Pat. Off. . | |
| 2653789 | 8/1977 | Fed. Rep. of Germany . | |
| 0117252 | 9/1981 | Japan . | |
| 0017957 | 1/1982 | Japan | 355/215 |
| 0019958 | 2/1984 | Japan | 355/30 |
| 0104972 | 6/1985 | Japan . | |
| 0210374 | 9/1986 | Japan . | |
| 0204652 | 10/1986 | Japan | 355/215 |
| 0121482 | 6/1987 | Japan . | |
| 0159836 | 7/1988 | Japan | 355/30 |

*Primary Examiner*—A. T. Grimley
*Assistant Examiner*—Nestor R. Ramirez
*Attorney, Agent, or Firm*—Foley & Lardner

[57] ABSTRACT

A copying machine includes an apparatus body and a cooling mechanism for cooling the interior of the body. The interior of the body is divided by plates into a first chamber enclosing an exposing unit and a second chamber enclosing an image carrier and a fixing unit. The cooling mechanism includes a cooling duct located between the image carrier and the fixing unit and extending along the image carrier, a first fan for drawing air from the second chamber through the cooling duct, and a second fan arranged in the first chamber so as to draw air therefrom.

8 Claims, 5 Drawing Sheets

COOLING SYSTEM FOR AN IMAGE FORMING APPARATUS

BACKGROUND OF THE INVENTION

1. Field of the Invention

The present invention relates to an image forming apparatus, such as an electronic copying machine.

2. Description of the Related Art

Generally, the body of an electronic copying machine is provided at its upper portion with a platen glass on which documents are placed. Arranged within the body itself is an image forming mechanism including a photosensitive drum which serves as the image carrier, an optical system for scanning documents with light and forming electrostatic latent images on the photosensitive drum in responsive to light reflected from the documents, a fixing device for fixing the images on sheets of paper, and the like. Among the components of the forming mechanism, the light source of the optical system and the fixing means become hot in particular. This makes it necessary for these elements to be cooled, and it is desirable that the photosensitive drum also be cooled to prevent it from being damaged by excessive heating.

For this purpose, a cooling fan is provided at that end portion of the apparatus body, which is adjacent to the light source and the fixing device, and draws air into the body through intake openings formed in the side thereof and discharges the air through discharge openings formed in the opposite side, thereby cooling components in the body, such as the light source, the fixing devices, and the photosensitive drum.

In the copying machine having the above-described arrangement, however, air is drawn into the body by using a single cooling fan arranged on one side of the body. Therefore, cooling efficiency is low and it is difficult to sufficiently cool the photosensitive drum. When the rotating speed of the fan is increased or a large fan is used so as to improve the cooling efficiency, noise becomes high and the economy of the machine is lowered.

SUMMARY OF THE INVENTION

The present invention has been contrived in consideration of the above circumstances, and its object is to provide an image forming apparatus capable of cooling the interior of the apparatus body with high efficiency.

In order to achieve the object, an image forming apparatus according to the present invention, comprises a body; image forming means arranged in the body and including an image carrier, and fixing means; and means for cooling the interior of the body. The cooling means includes a cooling duct arranged adjacent to and along the image carrier, and means for drawing air from the body and dischârging it outside the body through the cooling duct.

According to the image forming apparatus having the above-mentioned arrangement, since the cooling duct of the cooling means is located adjacent to and along the image carrier, air can be discharged outside with high efficiency from almost every region in the body as well as the region around the image carrier. This enables the inside of the body to be cooled with high efficiency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 through 3 show a first embodiment of an image forming apparatus according to the present invention, in which:

FIG. 1 is a sectional view showing the whole of the apparatus;

FIG. 2 is a perspective view schematically showing the apparatus while components except its cooling system are omitted;

FIG. 3 is a side view schematically showing the apparatus while components except its cooling system are omitted;

FIGS. 4 and 5 show a second embodiment of an image forming apparatus according to the present invention, in which:

FIG. 4 is a perspective view schematically showing the apparatus while components except its cooling system are omitted; and FIG. 5 is a side view schematically showing the apparatus while components except its cooling system are omitted.

DETAILED DESCRIPTION OF THE PREFERRED EMBODIMENTS

An electronic copying machine according to a first embodiment of the present invention will be described with reference to FIGS. 1 through 3.

Figure 1:
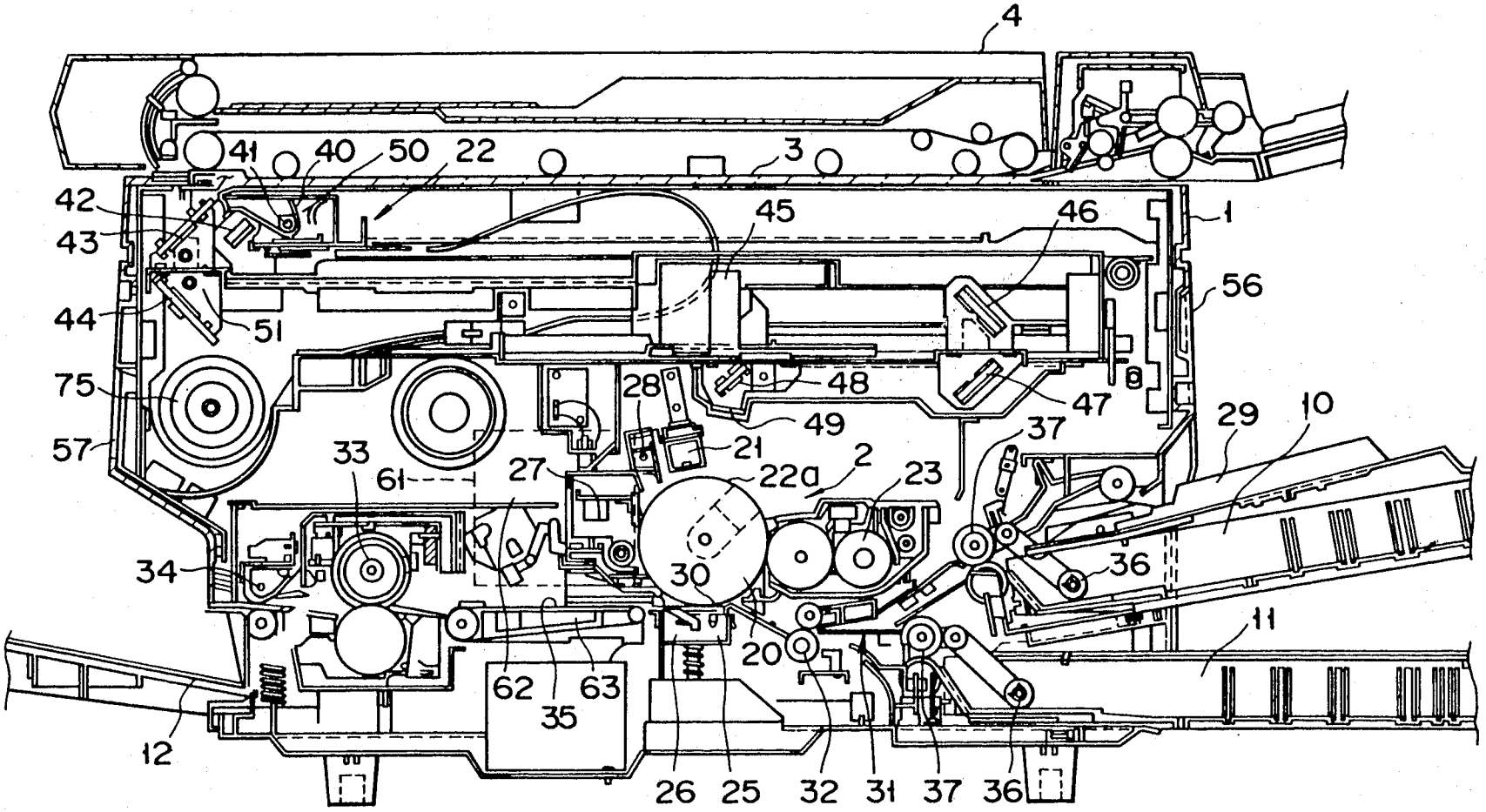

As shown in FIG. 1, the copying machine has main body 1, in which image forming system 2 is housed and carriers out an image forming processes comprising charging, exposing, developing, transferring, separating, cleaning, erasing, fixing and the like. Original table 3 (which will be hereinafter referred to as platen glass), on which documents are to be placed, is arranged on the top of body 1. Also arranged on the top of body 1 and above platen glass 3 is automatic document feeder for feeding documents and setting them on platen glass 3. Feeder 4 swingably mounted on machine body 1 and serving as a cover for platen glass 3.

Attached to the right side of machine body 1 are paper supply cassettes 10 and 11 enclosing paper sheets such as plane papers which are to be supplied to forming system 2. Tray 12 for receiving papers, on which images are fixed, is attached to the left side of body 1.

Image forming system 2 is constructed as follows. Photosensitive drum 20 which serves as the image carrier is arranged substantially in the center of machine body 1. Charger 21, exposing section **22*a* of exposing unit (or optical system) 22, developer unit 23, transfer unit 25, separating unit 26, cleaning unit 27, electric erasing unit 28 and the like are successively arranged around drum 20 in the rotating direction of drum 20**.

Formed in machine body 1 is paper feeding passage 31 for feeding papers, which have been automatically supplied from supply cassettes 10 and 11 or manually supplied through manual paper feed table 29, to tray 12 through image transfer section 30 between photosensitive drum 20 and transfer unit 25.

Resist rollers 32 are arranged on the upstream side of image transfer section 30 along feeding passage 31, and fixing unit 33 and paper discharge rollers 34 are arranged on the downstream side of the transfer section. A plurality of conveying belts 35 are arranged side by side along feeding passage 31 between separating unit 26 and fixing unit 33.

Arranged in machine body 1 are a pair of pickup rollers 36 for picking up one by one the papers from the corresponding cassettes 10 and 11, and separation/feed mechanisms 37 having conveying and separating rollers for receiving the picked up paper and feeding it into feeding passage 31.

Exposing unit 22 is located in the upper portion in machine body 1. This unit 22 includes exposing lamp 41, and reflector 40 surrounding the rear side of exposing lamp 41. Exposing means 22 is designed to scan a document set on platen glass 3 with light emitted from lamp 41, introduce light reflected from the document to lens 45 through first, second and third reflecting mirrors 42, 43 and 44, and then introduce it onto photosensitive drum 20 through fourth, fifth, sixth reflecting mirrors 46, 47 and 48, and slit glass 49.

Exposing lamp 41 and first reflecting mirror 42 are mounted on first carriage 50 which is reciprocatable along the undersurface of platen glass 3, and second and third reflecting mirrors 43 and 44 are mounted on second carriage 51 which is movable at a speed half that of first carriage 50 and in the same direction as first carriage 50 moves. When first and second carriages 50 and 51 are moved left to right in FIG. 1, using carriage shafts and the like as their guides, the document set on platen glass 3 is scanned by light and an image corresponding to the document is slit-exposed onto the outer circumference of photosensitive drum 20.

The right side wall of machine body 1 is provided with a plurality of intake openings 56 and the left side wall thereof with a plurality of discharge openings 57.

Figure 2:
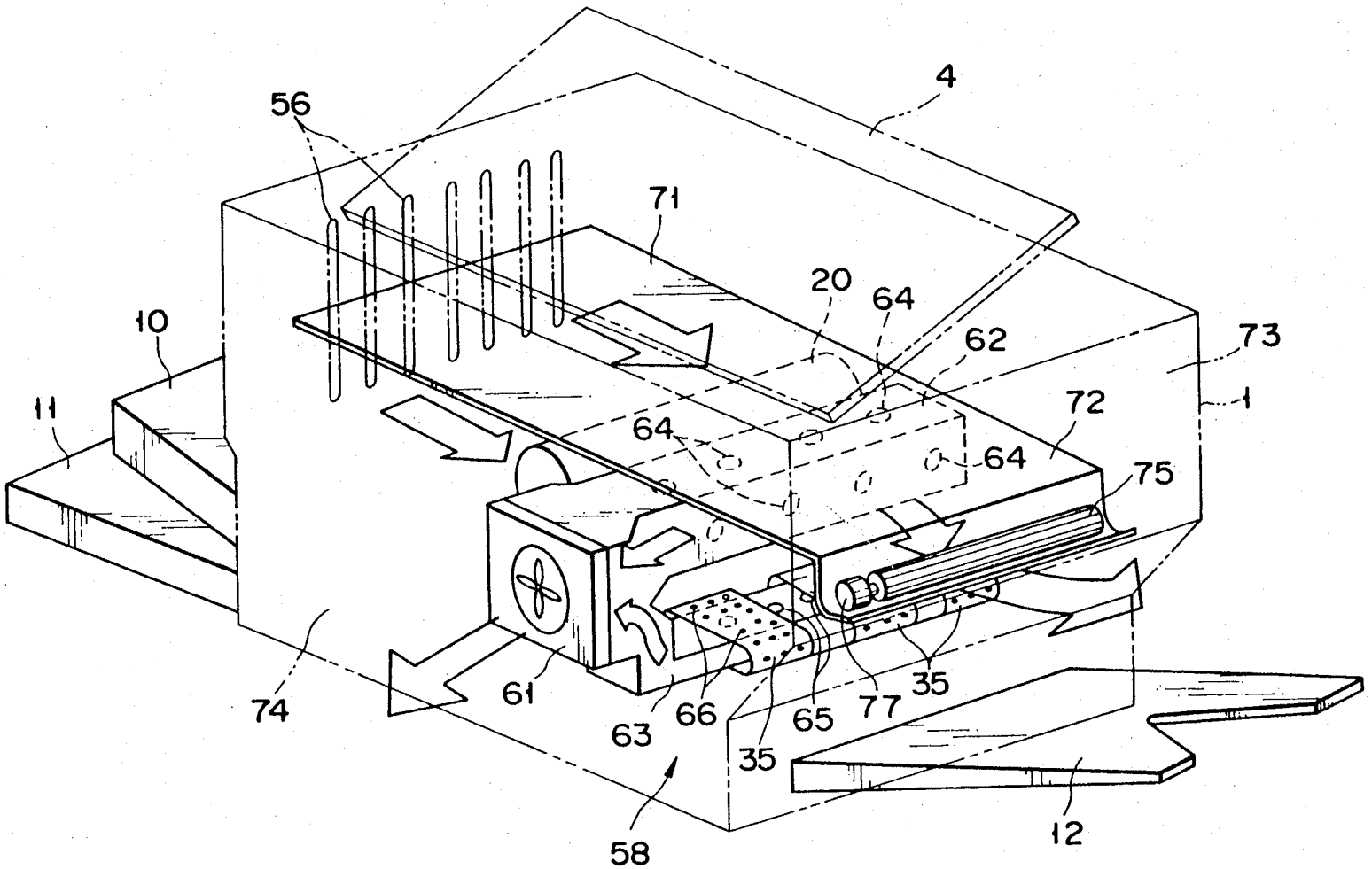

As shown in FIGS. 1 through 3, the interior of machine body 1 is partitioned, by base plate 71 supporting the optical system of exposing unit 22 and plate 72 as a partitioning member, into first chamber 73 next to platen glass 3 and second chamber 74 located below first chamber 73. Exposing unit 22, except for its fifth and sixth reflecting mirrors 47 and 48, is housed in first chamber 73, and system 2 for performing the image forming processes and other components are housed in second chamber 74. In base plate 71 is formed a slit (not shown) through which light reflected from fourth reflecting mirror 46 is introduced to fifth reflecting mirror 47.

Cooling mechanism 58 for cooling the interior of machine body 1 and for sucking and holding papers on conveying belts 65 is arranged in machine body 1. Cooling mechanism 58 includes cooling duct 62 and drawing duct 63 which are located in second chamber 74. Duct 62 is located between photosensitive drum 20 and fixing unit 33 and adjacent to drum 20, and extends in a direction perpendicular to the direction in which exposing lamp 41 moves, that is, in a direction parallel to the axial direction of drum 20. Duct 62 has a rectangular cross section and is provided with a plurality of suction ports 64 at its side walls. One end of duct 62 located on the front side of machine body 1 is closed while the other end thereof located on the rear side of machine body 1 is opened. First cooling fan 61 (or rectangular fan) is attached to this other end of duct 62. Fan 61 faces discharge openings formed in the rear side wall of machine body 1.

Drawing duct 63 extends parallel to cooling duct 62, passing through the inside spaces of conveying belts 35. Duct 63 has a rectangular cross section, and a plurality of suction ports 65 are formed in the upper side wall of duct 63, which faces advancing portions of conveying belts 35. Each of conveying belts 35 has a number of intake holes formed all over. One end of duct 63 located on the front side of machine body 1 is closed while the other end thereof located on the rear side of machine body 1 is connected to first cooling fan 61.

When cooling fan 61 is driven by a motor (not shown), therefore, air around duct 62 is sucked into duct 62 through suction ports 64 and outside air is drawn into second chamber 74 through intake openings of machine body 1, by the sucking action of the fan, as shown by arrows in FIG. 2, so that components in chamber 74 are cooled by the drawn air. At the same time, air on and above the upper surfaces of conveying belts 35 is sucked, due to the action of fan 61, into duct 63 through intake holes 66 of belts 35 and suction ports 65 of duct 63, thereby causing negative pressure applied to the upper surfaces of belts 35. This enables papers, which are passing on belts 35, to be sucked onto the upper surfaces of belts 35 and prevented from slipping from belts 35. Air drawn into ducts 62 and 63 is discharged outside through the discharge openings formed in the rear side wall of machine body 1.

Cooling mechanism 58 further includes second cooling fan (or line flow fan) 75 located in first chamber 73 and adjacent to discharge openings 57. Fan 75 extends parallel to photosensitive drum 20 and its one end is connected to fan motor 77. When fan 75 is driven by motor 77, therefore, outside air is drawn into first chamber 73 through intake openings 56 of machine body 1 and discharged from chamber 73 through discharge openings 57. Thus, exposing unit 22 is cooled by the air drawn.

The operation of the copying machine having the above-mentioned arrangement will be described. When a document is to be copied, it is set in automatic document feeder 4, and the "copy" button (not shown) is then pushed. The document is fed and set on platen glass 3, and exposing lamp 41 is turned on and first and second carriages 50 and 51 move along platen glass 3. Thus, the document is scanned, and light reflected from the document is introduced to lens 45 through first, second and third reflecting mirrors 42, 43 and 44 and then imaged on the outer circumference of photosensitive drum 20 through fourth, fifth, sixth and slit glass 49. At this time, the outer circumference of photosensitive drum 20 has been charged by charger 21, so that an electrostatic latent image which corresponds the image on the document is formed on the outer circumference of drum 20. This latent image is developed by developer supplied from developer unit 23.

On the other, papers in supply cassette 10 or 11 are successively picked up by pickup roller 36 and separated from the others and fed one by one to resist rollers 32 by means of separate feed mechanism 37. Each paper is aligned by resist rollers 32 and fed to image transfer section 30 located between photosensitive drum 20 and transfer unit 25, where the developed image on drum 20 is transferred onto the paper. The paper on which the image has been transferred is separated from drum 20 by the action of separating unit 26 and conveyed by conveying belts 35. Thereafter, the paper is fed to fixing unit 33 by which the image on the paper sheet is fixed, and then discharged on discharge tray 12 through discharge roller 38.

During the above-mentioned image forming operation, first and second fans 61 and 75 are driven. Outside air is drawn into first chamber 73 by the action of second fan 75, so that optical unit 22, particularly, exposing lamp 41 is cooled by the air. Air around cooling duct 62 is also sucked into duct 62 by the action of first fan 61, and thus, photosensitive drum 20 and fixing means 33 are cooled by the outside air flowing into chamber 74. At the same time, by the action of fan 61, the paper passing on conveying belts 35 is sucked onto the upper surfaces thereof, thereby allowing the paper to be surely conveyed to fixing unit 33 without slipping on conveying belts 35.

The copying machine constructed as described above has the following advantages.

Cooling mechanism 58 includes cooling duct 62 located between photosensitive drum 20 and fixing means 33 and nearer to drum 20. Therefore, air around drum 20 and fixing means 33 can be directly sucked into duct 62, so that drum 20 and fixing means 33 can be cooled with high efficiency.

Machine body 1 is partitioned into first and second chambers 73 and 74 by plates 71 and 72. This enables first fan 61 to serve only to draw air from second chamber 74, and second fan 75 to serve only to draw air from first chamber 73. Therefore, air in first and second chambers 73 and 74 can be efficiently drawn by these fans 61 and 75, thereby better cooling exposing unit 22, photosensitive drum 20, fixing unit 33 and the like. In addition, these fans 61 and 75 can be small in size and driven at a low speed, thereby enabling noise to be reduced. Further, first fan 61 is located on the rear side of machine body 1. Therefore, the operating sound of the machine hardly reaches the operator. This also reduce noise to a greater extent.

Intake duct 63, provided to suck paper sheets onto conveying belts 35, is connected, together with cooling duct 62, to first fan 61. Therefore, the cooling of second chamber 74 and the sucking of paper sheets onto conveying belts 35 are achieved only by single fan 61. No further fan for sucking paper sheets onto conveying belts 35 is needed. As compared with the case where independent cooling and sucking fans are used, therefore, the number of components used, noise and cost can be reduced to a greater extent.

Cooling system 58 has a single fan 75 arranged in first chamber 73. Even in this case, photosensitive drum 20, fixing means 33, exposing means 22 and the like can be cooled with high efficiency by the action of cooling duct 62, and the functions of cooling the machine and sucking papers onto the conveying belts can be achieved by single fan 61.

Figure 4:
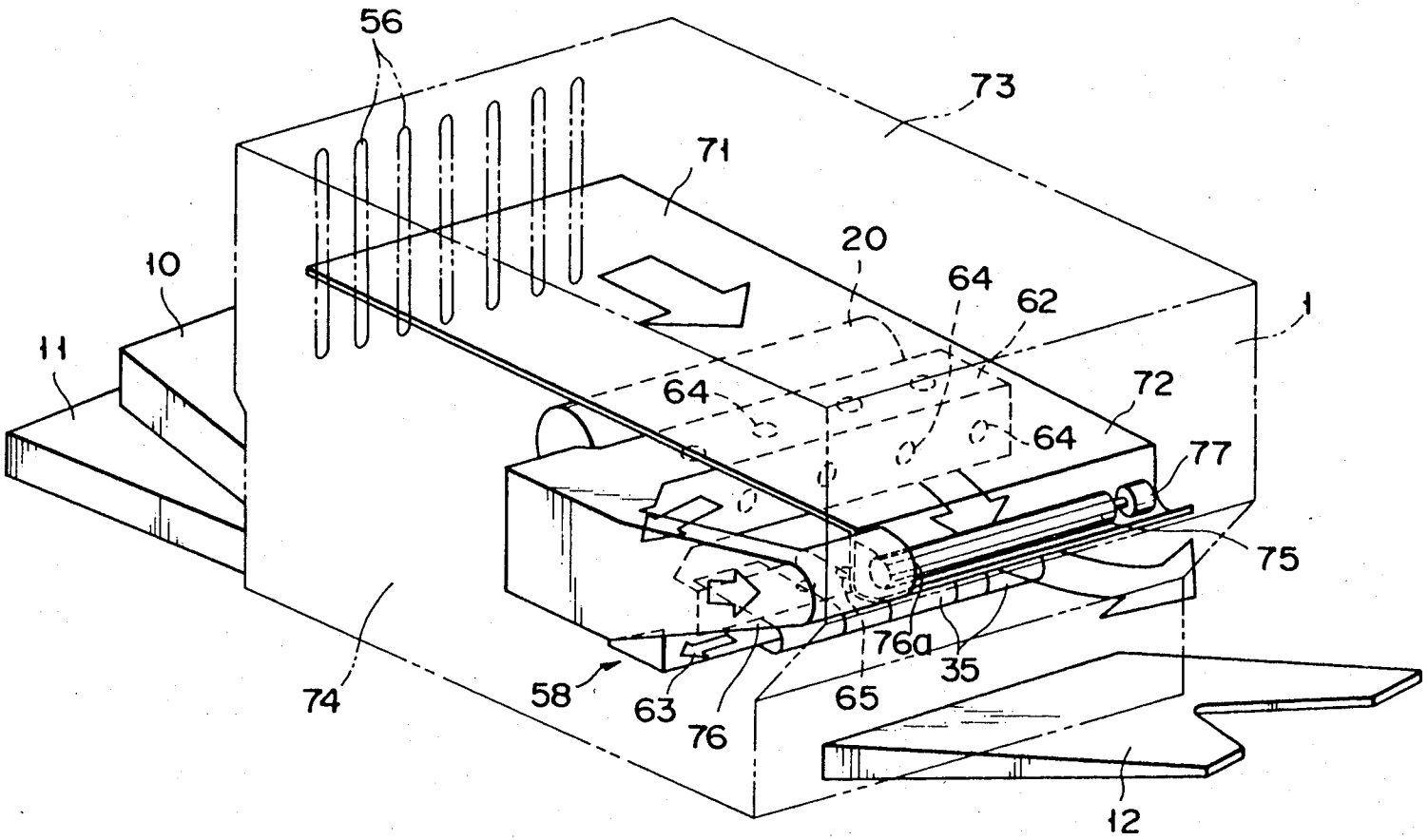
Figure 5:
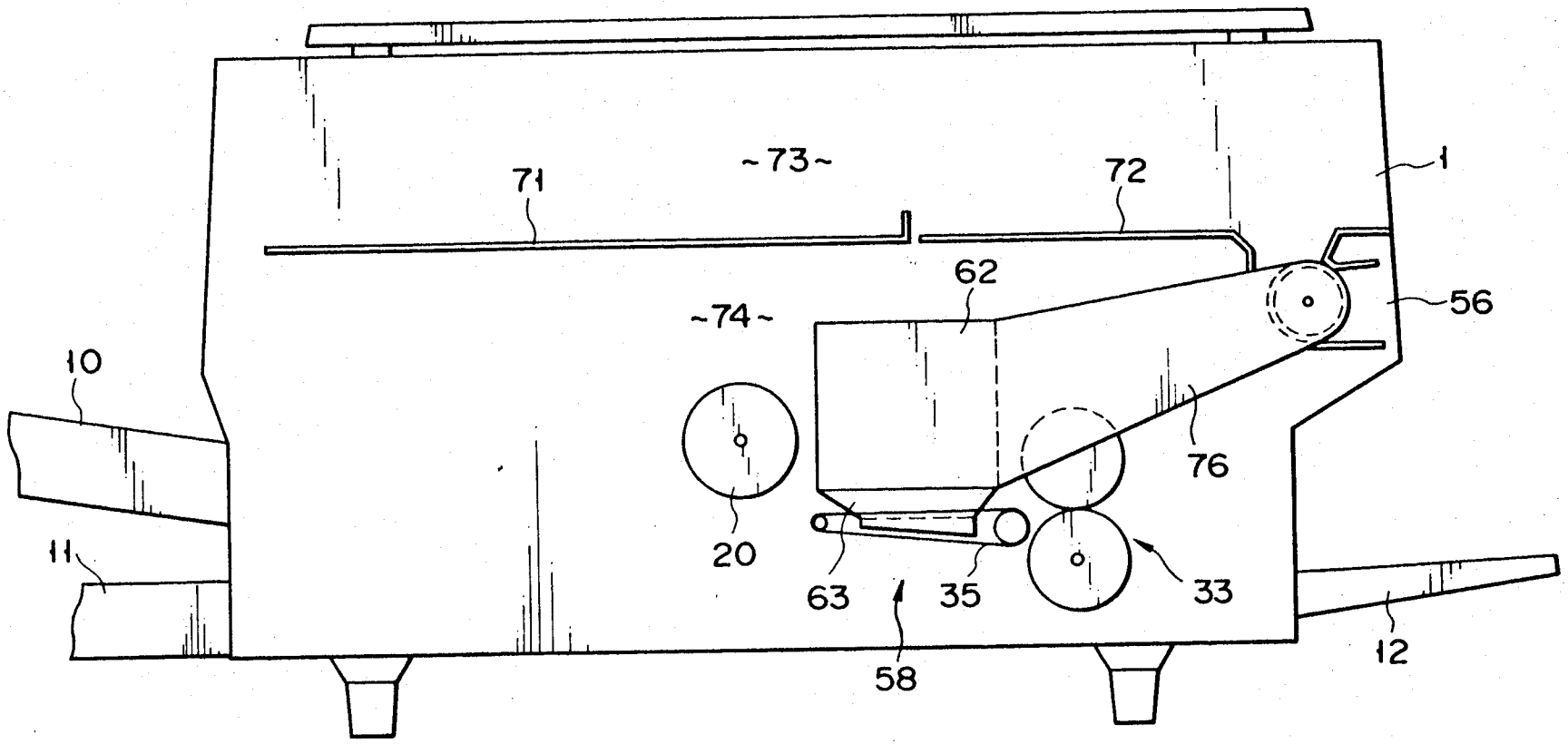

FIGS. 4 and 5 show an electronic copying machine according to a second embodiment of the present invention.

According to the second embodiment, cooling mechanism 58 is provided with single fan 75 located in first chamber 73. Those ends of cooling and intake ducts 62 and 63 which are located on the rear side of machine body 1 are connected to one end of communication duct 76. The other end of communication duct 76 extends into first chamber 73 through partition plate 72, and is located adjacent to fan 75. The other end of communication duct 76 is provided with suction opening **76*a*, and one end of fan 75 is inserted into the other end of duct 76 through suction opening 76*a***.

The other components and arrangement are same as in the first embodiment. The same parts are referred by the same reference numerals as in the first embodiment, and detailed description thereof will be omitted.

According to the second embodiment having the above-described arrangement, air in first chamber 73 is sucked by fan 75 to cool exposing unit 22 when fan 75 is driven. At the same time, air in second chamber 74 is sucked through communication and cooling ducts 76 and 62 to cool photosensitive drum 20, fixing unit 33 and the like. Further, air on and above the upper surfaces of conveying belts 35 is sucked through communication and intake ducts 76 and 63 to draw papers onto the upper surfaces of conveying belts 35.

Even in the case of this second embodiment, the photosensitive drum, fixing and exposing units can be cooled with high efficiency. In addition, the functions of cooling in first and second chambers 73 and 74 and drawing papers can be achieved by single fan 75. As compared with the first embodiment, therefore, the number of fans used can be reduced, so that noise and cost can be reduced to a far greater extent.

What is claimed is:

1. An image forming apparatus comprising:

an apparatus body;

means for forming images on a transfer medium, said forming means being arranged in said apparatus body and including an image carrier and means for exposing the image carrier;

means for partitioning the interior of said apparatus body into a first chamber enclosing said exposing means and a second chamber enclosing said image carrier; and means for cooling the interior of the apparatus body, said cooling means including a cooling duct arranged in said second chamber in parallel and adjacent to said image carrier and provided with a peripheral wall having a plurality of suction ports, a communication duct having a first end communicating with said cooling duct and a second end opening into said first chamber, and fan means arranged in said first chamber for sucking air in said first chamber and discharging it from the apparatus body and also for sucking air around said image carrier through said cooling duct and communication duct and discharging it from the apparatus body.

2. An apparatus according to claim 1, wherein said partitioning means includes a partitioning plate located in said apparatus body, said communication duct being arranged in said second chamber, so that said second end of the communication duct penetrates the partitioning plate to open to said first chamber.

3. An apparatus according to claim 1, wherein said communication duct includes a suction port opening to said first chamber, and said fan has a one end portion inserted into said suction port of the communication duct.

4. An apparatus according to claim 1, wherein said image forming means includes convey means for conveying said transfer medium, on which an image is transferred, to said fixing means, and said cooling means includes means for sucking and holding said transfer medium on said conveying means.

5. An apparatus according to claim 4, wherein said conveying means includes a convey belt having a number of suction holes formed therein, said suction and holding means includes a suction duct arranged close to said conveying belt and having a plurality of suction holes facing the convey belt, said suction duct having a one end communicating with said communication duct.

6. An image forming apparatus comprising:

an apparatus body;

means for forming images on a transfer medium, said forming means being arranged in said apparatus body and including an image carrier and means for exposing the image carrier;

means arranged in said apparatus body, for fixing the image, formed by said forming means, on the transfer medium;

means for conveying said transfer medium, on which an image is transferred, to said fixing means;

means for partitioning the interior of said apparatus body into a first chamber enclosing said exposing means and a second chamber enclosing said image carrier, fixing means and conveying means;

means for cooling the interior of the apparatus body, said cooling means including a cooling duct arranged in said second chamber and located between said image carrier and said fixing means parallel and adjacent to said image carrier, a communication duct having a first end communicating with said cooling duct and a second end opening into said first chamber, and fan means arranged in said first chamber for sucking air in said first chamber and discharging it from the apparatus body and for sucking air around said image carrier through said cooling duct and communication duct and discharging it from the apparatus body, said cooling duct being provided with a peripheral wall having a plurality of suction ports; and means for sucking and holding said transfer medium on said conveyor means, said sucking and holding means having a suction duct which is arranged in said second chamber and connected to said communication duct.

7. An apparatus according to claim 6, wherein said conveying means includes a conveying belt having a number of suction holes formed therein, said suction duct being arranged close to said convey belt and having a plurality of suction holes facing the convey belt.

8. An image forming apparatus comprising:

an apparatus body;

means for forming images on a transfer medium, said forming means being arranged in said apparatus body and including an image carrier and means for exposing the image carrier;

means for partitioning the interior of said apparatus body into a first chamber enclosing said exposing means and a second chamber enclosing said image carrier; and means for cooling the interior of the apparatus body, said cooling means including a cooling duct arranged in said second chamber near said image carrier, a communication duct having a first end communicating with said cooling duct, a second end opening into said first chamber, and a suction portion opening to said first chamber, and fan means arranged in said first chamber and having a one end portion inserted into said suction port of the communication duct, for sucking air in said first chamber and discharging it from the apparatus body and also for sucking air around said image carrier through said cooling duct and communication duct and discharging it from the apparatus body.

* * * * *